US008511792B2

(12) United States Patent
Ito

(10) Patent No.: US 8,511,792 B2
(45) Date of Patent: Aug. 20, 2013

(54) FLUID EJECTING APPARATUS

(75) Inventor: Koji Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 278 days.

(21) Appl. No.: 13/045,943

(22) Filed: Mar. 11, 2011

(65) Prior Publication Data

US 2011/0234699 A1 Sep. 29, 2011

(30) Foreign Application Priority Data

Mar. 25, 2010 (JP) ..... 2010-070167

(51) Int. Cl.
*B41J 2/165* (2006.01)

(52) U.S. Cl.
USPC ..... 347/30

(58) Field of Classification Search
USPC ..... 347/22, 23, 29–31, 33, 35
See application file for complete search history.

(56) References Cited

U.S. PATENT DOCUMENTS

| | | | | |
|---|---|---|---|---|
| 6,746,096 | B2 * | 6/2004 | Sakamoto et al. | 347/23 |
| 7,506,953 | B2 * | 3/2009 | Edamura et al. | 347/22 |
| 7,562,961 | B2 | 7/2009 | Inoue | |
| 2010/0118084 | A1 | 5/2010 | Seshimo | |

FOREIGN PATENT DOCUMENTS

| | | |
|---|---|---|
| JP | 2005-119284 | 5/2005 |

* cited by examiner

*Primary Examiner* — Lamson Nguyen
(74) *Attorney, Agent, or Firm* — Workman Nydegger

(57) ABSTRACT

A printer includes a printing head having nozzle rows formed from a plurality of nozzles, in which the nozzles for ejecting the ink in the Z-axis direction are discretely arranged in the Y-axis direction; a linear absorbing member which is spaced apart from the nozzles at a predetermined distance in the Z-axis direction, is tensed in the Y-axis direction, and has a ink receiving region capable of receiving the ink with the predetermined width in the X-axis direction; and the moving mechanism which moves the absorbing member to the flushing position in which the nozzle row and the ink receiving region to be opposed to each other in the Z-axis direction, and in which the nozzle row and the center line of the absorbing member are differently positioned in the X-axis direction, when preliminary ejecting the ink from the nozzle rows.

6 Claims, 10 Drawing Sheets

FLUID EJECTING APPARATUS

The entire disclosure of Japanese Patent Application No. 2010-070167, filed Mar. 25, 2010 is expressly incorporated by reference herein.

BACKGROUND

1. Technical Field

The present invention relates to a fluid ejecting apparatus.

2. Related Art

An ink jet printer (hereinafter referred to as a "printer") is widely known as a fluid ejecting apparatus capable of ejecting ink droplets onto a printing sheet. A maintenance process is regularly conducted by a printing head of such a printer so as to maintain or recover a good ejection characteristic. As the maintenance process, for example, there is a process of carrying out a flushing operation by preliminarily ejecting ink from each nozzle of the printing head regularly to prevent the nozzles from being clogged due to increased viscosity of the ink or to adjust a meniscus of the nozzle, and to normally eject the ink from the printing head, as well as a printing operation.

In general, although a printing head is moved to an area other than a printing area to carry out the flushing operation in a scan type printer, the printer equipped with a line head with a fixed printing head is not able to move the printing head during flushing operation. Accordingly, for example, a method of ejecting the ink into an absorbing material, which is provided on a surface of a transporting belt for transporting the printing sheet, has been considered (refer to JP-A-2005-119284).

However, in the technology disclosed in JP-A-2005-119284, since a plurality of absorbing materials are placed at regular intervals on the transporting belt to coincide with the size of the printing sheet, during flushing the ink should be ejected while aiming for a gap between the printing sheets. Therefore, there is a problem that the size of the printing sheets or the transporting speed of the printing sheet is limited. In addition, if the flushing is carried out with respect to the planar absorbing material, misted ink is scattered by the wind pressure which is generated by the discharge of the ink droplets, so that the surface of the printing sheet or the transporting belt may become contaminated.

Accordingly, a method of receiving the ink onto the absorbing member is considered, in which a linear member is used as a absorbing material, the linear member is interposed between the line head and the printing sheet, and the linear member is moved to a position opposite to a nozzle row during flushing operation, so that the linear member receives the ink.

However, the linear member may vibrate upon movement, so that vibration has a negative influence upon the effective implementation of the flushing operation.

SUMMARY

An advantage of some aspects of the invention is to provide a fluid ejecting apparatus capable of effectively carrying out a flushing operation in a case where a linear member is used for a member which receives a fluid.

According to an aspect of the invention, there is provided a fluid ejecting apparatus including a fluid ejecting head having nozzle rows formed from a plurality of nozzles, in which the nozzles for ejecting a fluid in a first direction are discretely arranged in a second direction perpendicular to the first direction; a circular-sectioned linear member which is spaced apart from the nozzles at a predetermined distance in the first direction, is tensed in the second direction, and has a fluid receiving region capable of receiving the fluid at a predetermined width in a third direction perpendicular to the first direction and the second direction; and a moving device which arranges the nozzle rows and the fluid receiving region to be opposed to each other in the first direction, and moves the linear member to a fluid receiving position in which the nozzle rows and the center line of the linear member are differently positioned in the third direction, when the fluid is preliminarily ejected from the nozzle rows.

With such a configuration of the invention, since the linear member has a fluid receiving region with a determined width in the third direction, the position of the center line of the linear member can be different from the position of the nozzle row in the third direction. Even though the linear member vibrates in the first direction, the vertex of the vibration can be deviated from the nozzle row. As a result, it is possible to prevent a breakdown of a meniscus due to contact of the linear member with the nozzle row.

It is preferable that the invention employs a configuration in which the moving device moves the linear member in the third direction between the fluid receiving position and a retraction position in which the nozzle rows and the fluid receiving region are not opposite to each other.

With the above configuration of the invention, the linear member located at the fluid receiving position can receive the fluid at the time of a flushing operation, while the linear member can be located at the retraction position at the time of a printing operation to ensure an ejection path of the fluid from the nozzles.

In addition, it is preferable that the invention employs a configuration in which the moving device decelerates the movement of the linear member further to the front side than the fluid receiving position in the third direction, when the linear member is moved from the retraction position to the fluid receiving position.

With the above configuration of the invention, when the linear member is moved from the retraction position to the fluid receiving position, the linear member is decelerated further to the front side than the fluid receiving position. As a result, it is possible to suppress the vibration of the linear member in the third direction, as compared with a case where the linear member is suddenly stopped at the fluid receiving region.

Further, it is preferable that the invention employs a configuration in which the center line is located at a position opposite to the retraction position across the nozzle rows in the fluid receiving position, and the moving device decelerates the linear member further to the front side than the nozzle row in the third direction.

With the above configuration of the invention, when the linear member is moved from the retraction position to the fluid receiving position, if the linear member is decelerated further to the front side than the nozzle row, the linear member starts to vibrate in the third direction from the front. For this reason, if the position of the center line in the fluid receiving position is arranged further to the rear side (inside) than the nozzle row in the third direction, the linear member starts to vibrate in the third direction from the front, and the time from the start of the movement of the linear member to the start of the flushing operation can be shortened.

In addition, it is preferable that the invention employs a configuration further including a control device which initiates preliminary ejection when an amplitude region of the vibration of the linear member in the third direction due to the deceleration is within a region of a predetermined width centered on the nozzle row.

With the above configuration of the invention, if the linear member vibrates in the third direction within the predetermined width of the fluid receiving region, the flushing operation can be initiated at a timing avoiding leakage of the received fluid when the vibration region is within the region of the predetermined width centered on the nozzle row.

Further, it is preferable that the invention employs a configuration in which the preliminary ejection is executed within one cycle of the vibration after the preliminary ejection is initiated.

With the above configuration of the invention, it is possible to prevent the leakage of the received fluid due to the vibration by carrying out the flushing operation within one cycle of the vibration of the linear member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
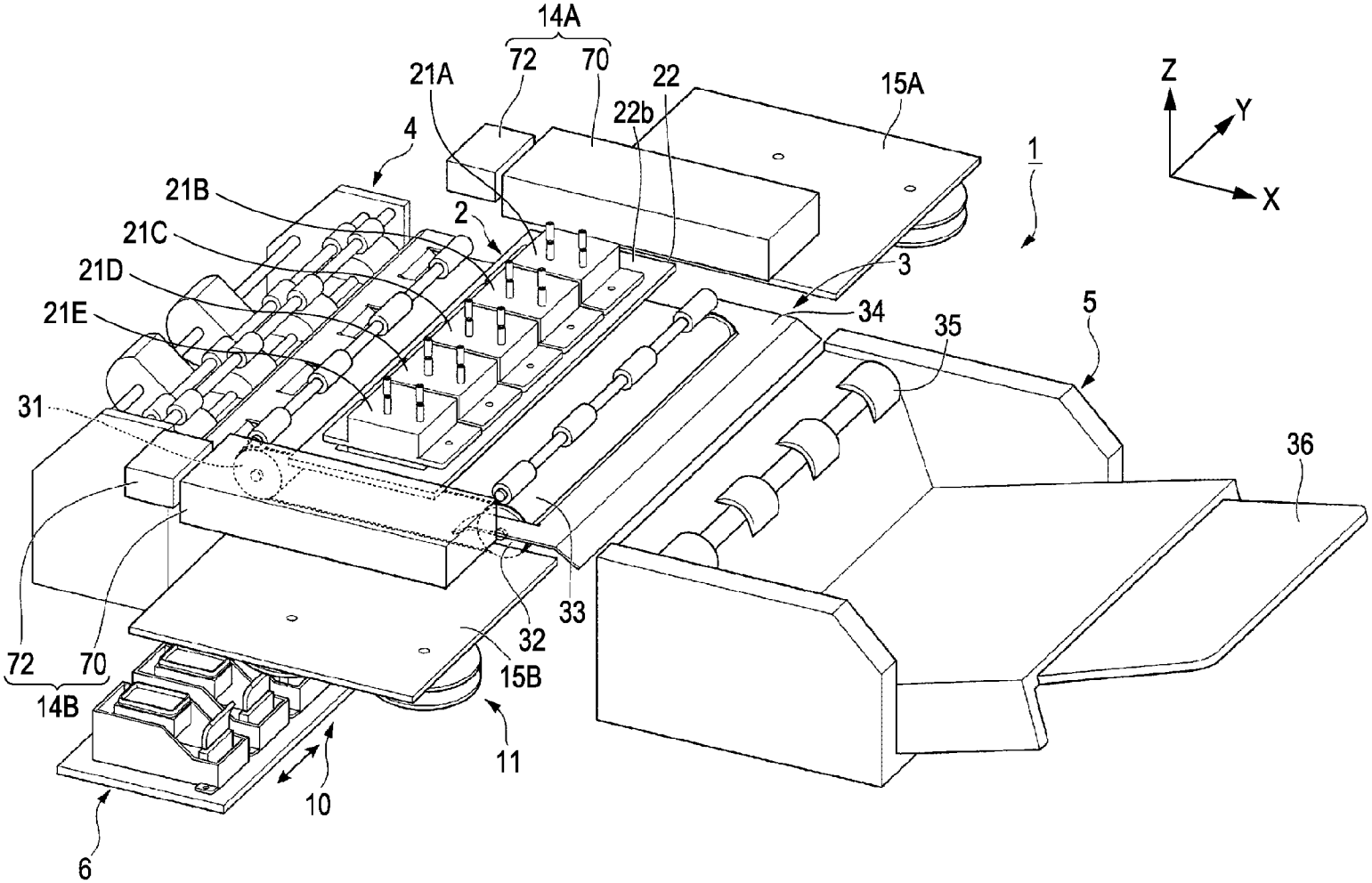
FIG. 1 is a perspective view schematically illustrating the configuration of a printer according to an embodiment of the invention.

A fluid ejecting apparatus according to an embodiment of the invention will now be described with reference to the accompanying drawings. In this instance, in the various drawings used in the following description, the scales of the various components are appropriately modified in order to allow each component to have a recognizable size. Further, in the drawings used in the following description, there is a case where a Cartesian coordinate system is set, and then a positional relationship of each component is described with reference to the Cartesian coordinate system. In such a case, a predetermined direction in a horizontal plane is set to the X-axis direction (third direction), a direction perpendicular the X-axis direction in the horizontal plane is set to the Y-axis direction (second direction), and a direction (that is, vertical direction) respectively perpendicular to the X-axis direction and the Y-axis direction is set to the Z-axis direction (first direction).

In this embodiment, an ink jet printer (hereinafter, simply referred to as a printer) is exemplified as the fluid ejecting apparatus.

Figure 2:
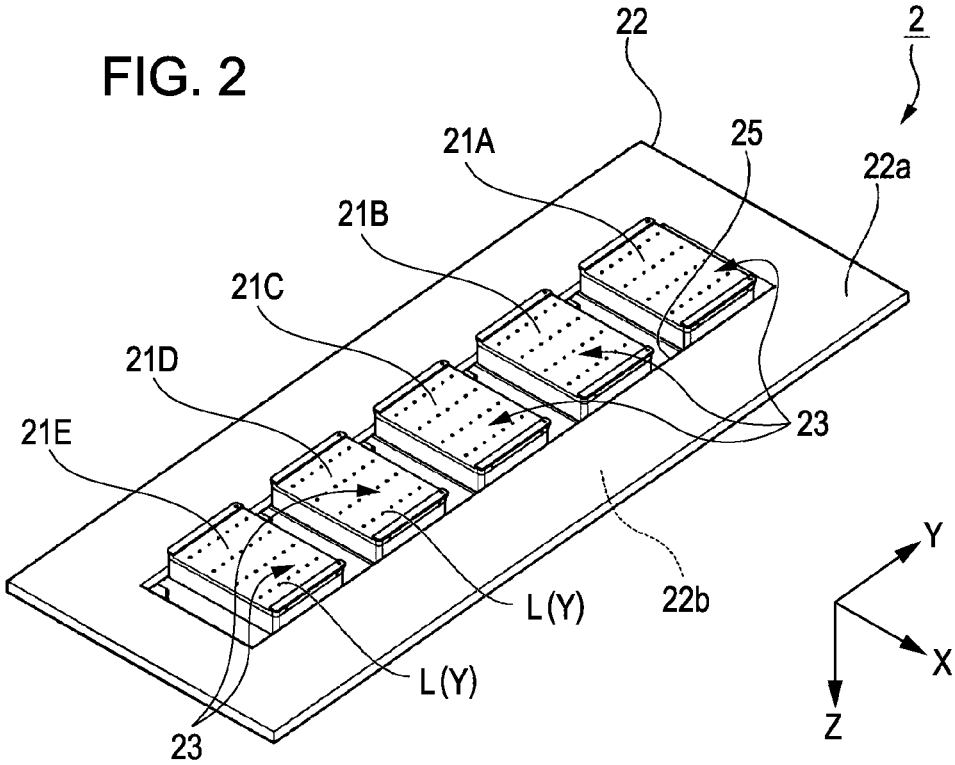
FIG. 2 is a perspective view schematically illustrating the configuration of a head unit according to an embodiment of the invention.
Figure 3:
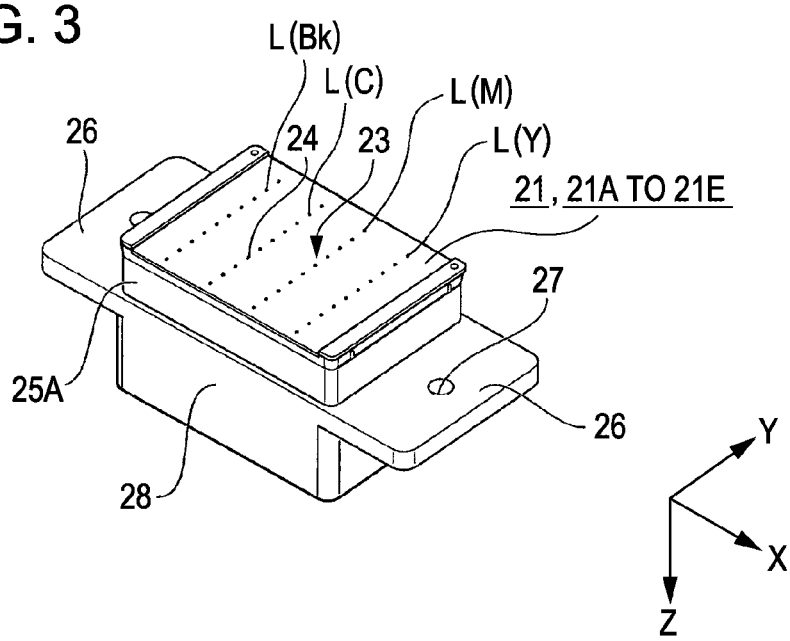
FIG. 3 is a perspective view schematically illustrating the configuration of a printing head constituting a head unit according to an embodiment of the invention.
Figure 4:
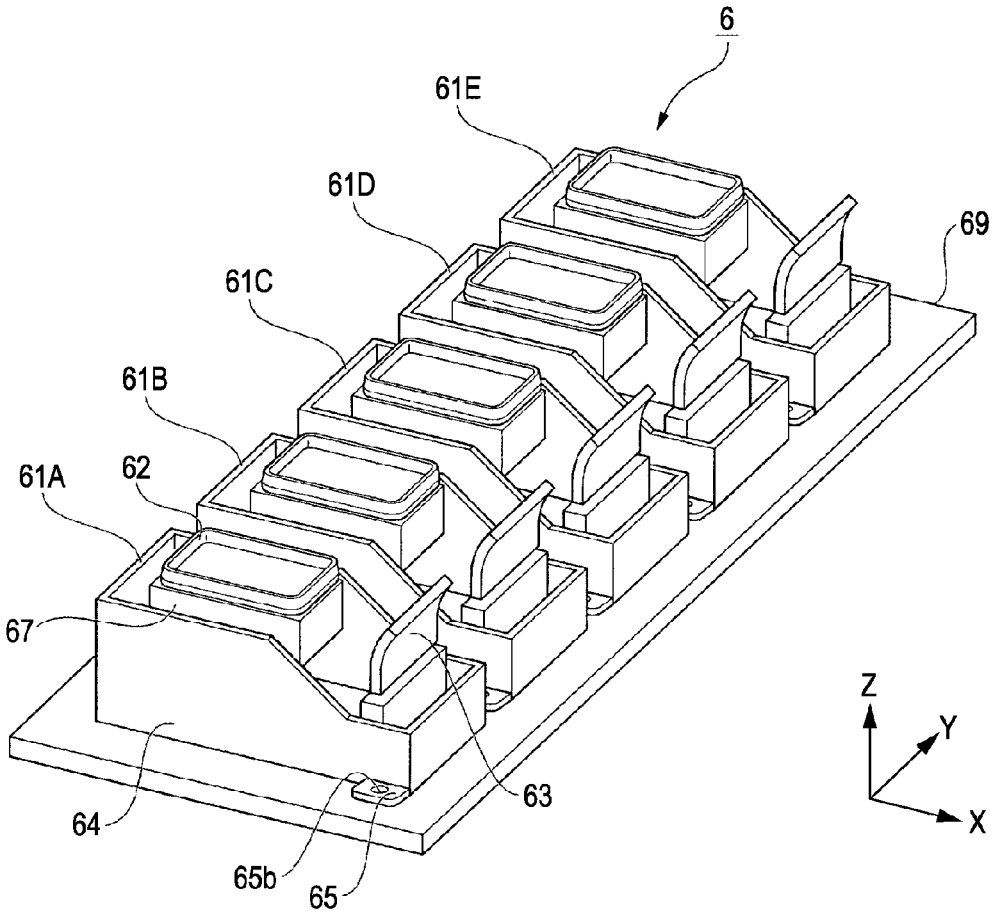
FIG. 4 is a perspective view schematically illustrating the configuration of a cap unit according to a first embodiment.

FIG. 1 is a perspective view schematically illustrating the configuration of the printer. FIG. 2 is a perspective view schematically illustrating the configuration of a head unit. FIG. 3 is a perspective view schematically illustrating the configuration of a printing head (fluid ejecting head) constituting the head unit. FIG. 4 is a perspective view schematically illustrating the configuration of a cap unit.

As shown in FIG. 1, a printer 1 includes a head unit 2, a transporting device 3 which transports a printing sheet (printing medium), a sheet feeding unit 4 which supplies the printing sheet, a sheet discharging unit 5 which discharges the printing sheet subjected to a printing operation of the head unit 2, a maintenance device 10 which performs a maintenance operation on the head unit 2, and a control device (not illustrated) which collectively controls the overall of the respective units.

The transporting device 3 is adapted to hold the printing sheet while maintaining a predetermined gap in the Z-axis direction between the printing sheet and nozzle surfaces 23 (refer to FIGS. 2 and 3) of printing heads (fluid ejection head) 21 (21A, 21B, 21C, 21D, and 21E) constituting the head unit 2. The transporting device 3 includes a driving roller portion 31, a driven roller portion 32, and a transporting belt portion 33 which has plural belts suspended between the roller portions 31 and 32. In addition, a holding member 34 is provided between the sheet discharging units 5 which is the downstream side of the transporting device 3 (on the side of the sheet discharging unit 5) in a transport direction (X-axis direction) of the printing sheet so as to hold the printing sheet.

One end of the driving roller portion 31 in the rotation axis direction is connected to a driving motor (not illustrated), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 35 and a sheet discharging tray 36 which holds the printing sheet transported by the sheet discharging roller 35.

The head unit 2 is formed as a unit including plural (in this embodiment, five) printing heads 21A to 21E, and plural colors of ink (for example, ink having the colors black B, magenta M, yellow Y, and cyan C) adapted to be ejected in the −Z direction from nozzles 24 (refer to FIG. 3) of the printing heads 21A to 21E. The printing heads 21A to 21E (hereinafter, referred to as the printing heads 21 in some cases) are formed as a unit which is attached to an attachment plate 22. That is, the head unit 2 according to this embodiment constitutes a line head module which has plural combinations of printing heads 21 and in which an effective printing width of the head unit 2 is substantially equal to the transverse width (the width perpendicular to the transport direction of the printing sheet) of the printing sheet in the Y-axis direction. In addition, the printing heads 21A to 21E have the same structure. In this instance, the head unit 2 may be formed from arranging the plurality of printing heads 21 in a staggered pattern.

As shown in FIG. 2, the head unit 2 has a configuration in which the printing heads 21A to 21E are arranged inside an opening 25 formed in an attachment plate 22. More specifically, the printing heads 21A to 21E are screw-fixed to a rear surface 22*b* side of the attachment plate 22 so that the nozzle surfaces 23 project from a front surface 22*a* of the attachment plate 22 through the opening 25. In addition, the head unit 2 is mounted onto the printer 1 by fixing the attachment plate 22 to a carriage (not illustrated).

The head unit 2 according to this embodiment is adapted to be movable between a printing position and a maintenance position (in a direction depicted by the arrow in FIG. 1) by the carriage. Here, the printing position is a position which faces the transporting device 3 and in which a printing operation is performed on the printing sheet. Meanwhile, the maintenance position is a position in which the head unit 2 is retracted from the transporting device 3 and which faces a maintenance device 10. In the maintenance position, a maintenance process (a suction process and a wiping operation) is performed on the head unit 2.

As shown in FIG. 3, each of the printing head 21 constituting the head unit 2 includes a head body 25A which has the nozzle surface 23 having nozzle rows L formed from plural nozzles 24 and a support member 28 onto which the head body 25A is mounted.

Each of the printing heads 21A to 21E has four nozzle rows (L(Y), L(M), L(C), and L(Bk)) corresponding to four colors (yellow (Y), magenta (M), cyan (C), and black (Bk)). In the nozzle rows (L(Y), L(M), L(C), and L(Bk)), the nozzles 24 constituting the nozzle rows (L(Y), L(M), L(C), and L(Bk)) are arranged in the horizontal direction (Y-axis direction) perpendicular to the transport direction of the printing sheet, and more specifically, are arranged in the horizontal direction perpendicular to the transport direction of the printing sheet. In addition, in the direction where the printing heads 21A to 21E are arranged, the respective nozzle rows are arranged so that the nozzle rows L having the same color are aligned in a line in the printing heads 21A to 21E. Meanwhile, in the respective nozzle rows (L(Y), L(M), L(C), and L(Bk)) of each printing heads 21A to 21E, two nozzle rows may be formed for each color of (Y), (M), (C), and (Bk) to form eight nozzle rows in total. In this instance, it is preferable that the two nozzle rows L provided for each color are placed in a staggered pattern.

Projecting portions 26 and 26 are formed on both sides of the support member 28 in the longitudinal direction of the nozzle surface 23. In addition, each of the projecting portions 26 and 26 is provided with a penetration hole 27 which is used to screw-fix the printing head 21 to the rear surface 22*b* of the attachment plate 22. Accordingly, the head unit 2 is obtained in which the plurality of printing heads 21 is attached to the attachment plate 22 (refer to FIG. 1).

The maintenance device 10 includes a cap unit 6 which receives the ink ejected by the flushing operation of the head unit 2 and a flushing unit 11 which performs the suction operation.

As shown in FIG. 4, the cap unit 6 is a unit which performs the maintenance operation on the head unit 2 and includes a plurality (in this embodiment, five) of cap portions 61A to 61E respectively corresponding to the printing heads 21A to 21E. The cap unit 6 is disposed at a position deviated from the printing area of the head unit 2.

The cap portions 61A to 61E (hereinafter, simply referred to as a cap portion 61 in some cases) respectively correspond to the printing heads 21A to 21E, and are adapted to respectively come into contact with the nozzle surfaces 23 of the printing heads 21A to 21E. Since the cap portions 61A to 61E respectively come into close contact with the nozzle surfaces 23 of the printing heads 21A to 21E with the above configuration, it is possible to satisfactorily perform the suction operation in which ink (fluid) is discharged from each of the nozzles 24 of the nozzle surfaces 23 by applying a negative pressure through a suction pump (not illustrated).

In addition, each of the cap portions 61A to 61E includes a cap body 67, a seal member 62 which is formed on the upper surface of the cap body 67 so as to have a frame shape and come into contact with the printing head 21, a wiper member 63 which is used in the wiping operation of wiping the nozzle surface 23 of the printing head 21, and a housing portion 64 which integrally retains the cap body 67 and the wiper member 63.

The bottom portion of the housing portion 64 is provided with two holding portions 65 (here, one of them is not shown in the drawing) which are used to hold the housing portion 64 in a base member 69. The holding portions 65 are disposed in the housing portion 64 so as to have a diagonal relationship therebetween at a plan view. Each of the holding portions 65 is provided with a penetration hole 65*b* into which a screw is inserted so as to screw-fix the housing portion 64 to the base member 69.

Figure 5:
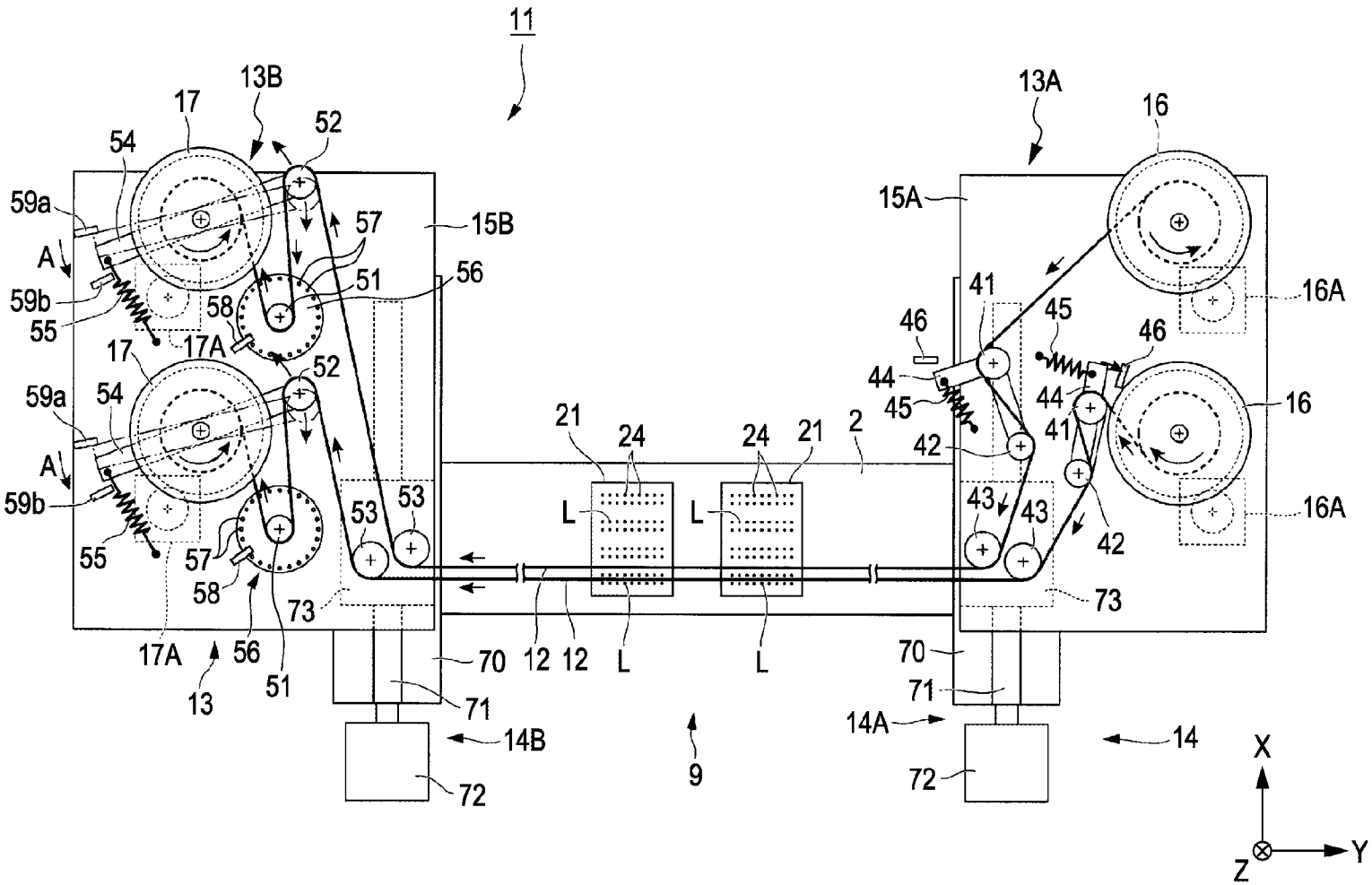
FIG. 5 is a bottom plan view schematically illustrating the configuration of a flushing unit according to an embodiment of the invention.

FIG. 5 is a bottom plan view schematically illustrating the configuration of the flushing unit 11.

As shown in FIG. 5, the flushing unit 11 includes a linear member (absorbing member) 12 which absorbs ink droplets (fluid) ejected during the flushing operation, and a support mechanism 9 which supports the absorbing member 12.

The absorbing member 12 is formed as a linear member which absorbs the ink droplets ejected from each nozzle 24. In this embodiment, two absorbing members are provided for one head unit 2. The absorbing member 12 is tensed by the support mechanism 9 in a state where it is extended in the Y-axis direction along the corresponding nozzle rows (L(Y), L(M), L(C), and L(Bk)). In addition, the absorbing member 12 is spaced apart from the nozzle surfaces 23 at a predetermined distance between the nozzle surfaces 23 and a sheet transporting region of the printing sheet in the Z-axis direction.

The absorbing members 12 are formed of, for example, a yarn material or the like. It is preferable to use a material capable of effectively absorbing and holding (containing) the ink. Specifically, the absorbing member 12 may be formed of, for example, fiber such as SUS 304, nylon, nylon applied with a hydrophobic coating, aramid, silk, cotton, polyester, ultra-high molecular weight polyethylene, polyarylate, or Zylon (product name), or a compound fiber containing a plurality thereof.

More specifically, it is possible to form the absorbing member 12 in such a manner that a plurality of fiber bundles formed from the fiber or the compound fiber are twisted or bound.

Figure 6A:
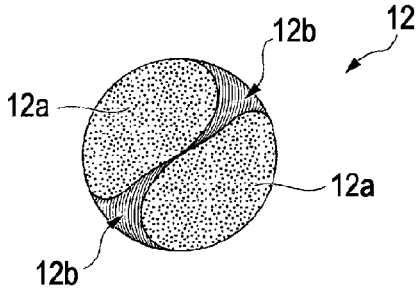
FIG. 6 is a view schematically illustrating an example of the configuration of an absorbing member according to an embodiment of the invention.
Figure 6B:
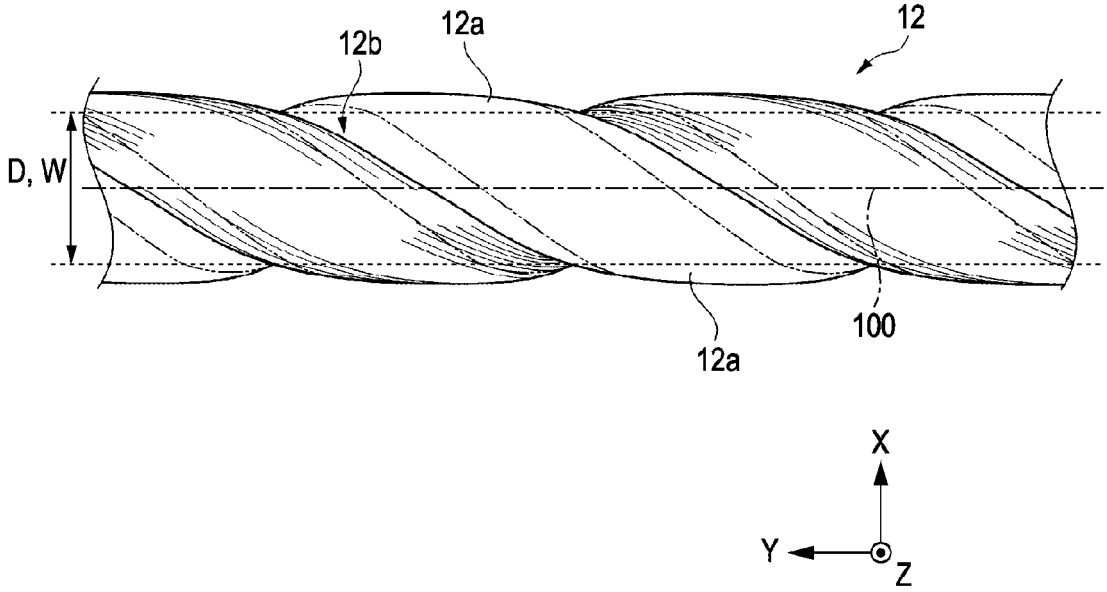

FIGS. 6A and 6B are schematic diagrams showing an example of the absorbing member 12, where FIG. 6A is a cross-sectional view and FIG. 6B is a plan view. As shown in FIGS. 6A and 6B, for example, the absorbing member 12 is formed in such a manner that two fiber bundles 12*a* formed from the fiber are twisted.

In addition, as other example, a linear member obtained by binding a plurality of fiber bundles formed from SUS 304, a linear member obtained by binding a plurality of fiber bundles formed from nylon, a linear member obtained by binding a plurality of fiber bundles formed from nylon applied with hydrophobic coating, a linear member obtained by binding a plurality of fiber bundles formed from aramid, a linear member obtained by binding fiber bundles formed from silk, a linear member obtained by binding a plurality of fiber bundles formed from cotton, a linear member obtained by binding a plurality of fiber bundles formed from Belima (product name), a linear member obtained by binding a plurality of fiber bundles formed from Soierion (product name), a linear member obtained by binding a plurality of fiber bundles formed from Hamilon 03T (product name), a linear member obtained by binding a plurality of fiber bundles formed from Dyneema hamilon DB-8 (product name), a linear member obtained by binding a plurality of fiber bundles formed from Vectran hamilon VB-30, a linear member obtained by binding a plurality of fiber bundles formed from Hamilon S-5 Core Kevlar Sleeve Polyester (product name), a linear member obtained by binding fiber bundles formed from Hamilon S-212 Core Coupler Sleeve Polyester (product name), a linear member obtained by binding a plurality of fiber bundles formed from Hamilon SZ-10 Core Zylon Sleeve Polyester (product name), or a linear member obtained by binding a plurality of fiber bundles formed from Hamilon VB-3 Vectran (product name) may be appropriately used as the absorbing member 12.

Since the absorbing member 12 obtained by the fiber of nylon is formed from nylon widely used as all purpose leveling line, the absorbing member 12 is inexpensive.

Since the absorbing member 12 obtained from the metallic fiber of SUS has excellent corrosion resistance properties, it is possible to allow the absorbing member 12 to absorb a variety of ink. Also, since the absorbing member 12 has excellent wear resistance properties compared to resin, it is possible to repeatedly use the absorbing member 12.

The absorbing member 12 obtained from the fiber of ultrahigh molecular weight polyethylene has high cutting strength and chemical resistance, and is strong against organic solvents, acids, or alkali. Likewise, since the absorbing member 12 obtained from the fiber of ultrahigh molecular weight polyethylene has a high breaking strength, it is possible to pull the absorbing member 12 in a high-tension state, and to prevent the absorbing member 12 from bending. For this reason, in a case where the diameter of the absorbing member 12 is thickened so as to increase the absorbing capacity or the diameter of the absorbing member 12 is not thickened, it is possible to improve the printing precision by narrowing the distance between the printing sheet transporting region and the heads 21A to 21E. In addition, it is expected that the above-described advantage is obtained even in an absorbing member 12 obtained from the fiber of Zylon or aramid and an absorbing member 12 obtained from the fiber of ultrahigh molecular polyethylene.

The absorbing member 12 obtained from cotton fibers has excellent ink absorbing properties.

In the absorbing member 12, the dropped ink is retained due to the surface tension between the fibers and in the valley portion 12*b* formed between the fiber bundles 12*a*, so that the ink is absorbed and contained.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12*b*, and the rest remains in the valley portion 12*b* so as to be held therein while being dispersed in the extension direction of the absorbing member 12. That is, not all the ink dropped onto the surface of the absorbing member 12 stays at the dropped position over an extended period, but is dispersed and absorbed in the vicinity of the dropped position.

In fact, a material forming the absorbing member 12 provided in the printer 1 is selected appropriately in consideration of ink absorbing properties, ink holding property, tensile strength, ink resistance properties, formability (generation of fluff or fraying), distortion, costs, and the like.

In addition, the ink absorbing amount of the absorbing member 12 is the total of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing operation in consideration of the frequency of replacing the absorbing member 12.

In this instance, the amount of ink held between the fibers of the absorbing member 12 and the amount of ink held in the valley portion 12*b* may be determined by the contact angle between the ink and the fiber, and the capillary force between the fibers depending on the surface tension of the ink. That is, when the absorbing member 12 is formed from thin fibers, the gap between the fibers increases and the entire surface area of the fiber increases. Accordingly, even when the sectional area of the absorbing member 12 is uniform, the absorbing member 12 is capable of absorbing a larger amount of ink. As a result, in order to obtain more gaps between the fibers, a microfiber (ultrafine fiber) may be used as the fiber forming the fiber bundle 12*a*.

However, the ink holding force of the absorbing member 12 decreases since the capillary force decreases due to an increase in the gap between the fibers. For this reason, it is necessary to set the gap between the fibers so that the ink holding force of the absorbing member 12 is equal to such an extent that ink is not dropped due to the movement of the absorbing member 12.

Furthermore, the thickness (diameter) of the absorbing member 12 is set to, for example, about 5 to 75 times larger than the diameter (nozzle diameter) of the nozzle 24. In general printers, the gap between each nozzle surface 23 and the printing sheet in each of the printing heads 21A to 21E is set to about 1 mm to 2 mm, and the nozzle diameter is set to about 0.02 mm. Accordingly, if the diameter of the absorbing member 12 is 0.5 mm or less, the absorbing member 12 can be interposed between each nozzle surface 23 and the printing sheet, without coming into contact with each nozzle surface 23 or the printing sheet. If the diameter is 0.2 mm or more, the absorbing member is able to reliably capture the ejected ink droplets even when taking into consideration a certain degree of tolerance in components. For this reason, it is preferable that the absorbing member 12 has a thickness (diameter) of about 0.2 mm to 0.5 mm, that is, about 10 to 25 times larger than the nozzle diameter. The cross section of the absorbing member 12 may not necessarily be formed in a circular shape, but may be formed in a polygonal shape, since it is difficult to form the absorbing member in a perfect circular shape. A substantially circular shape is also included as a circle.

In this embodiment, the nozzle 24 having the diameter of 0.02 mm and the absorbing member 12 having the diameter of 0.5 mm will be described.

As shown in FIG. 6B, the absorbing member 12 has an ink receiving region D capable of receiving the ink ejected from the nozzles 24, and the ink receiving region D has a predetermined width W in the X-axis direction. The ink receiving region D is a region of a horizontal plane of the absorbing member 12 which is obtained from subtracting the depth of the valley 12*b* from the diameter of the absorbing member 12 in the X-axis direction. If the depth of the valley portion 12*b* according to the embodiment is 0.05 mm, the width W of the ink receiving region D is 0.4 mm. Accordingly, the absorbing member 12 according to the embodiment includes the ink receiving region D having the sum of 0.4 mm in width, in which 0.2 mm in width is respectively set at both sides thereof centered on the center line 100.

In this instance, it is preferable that the absorbing member 12 has a sufficient length with respect to an effective printing width of the head unit 2. The printer 1 according to the embodiment employs a configuration in which the absorbing member 12 is replaced in its entirety when the used (ink absorption completed) region of the absorbing member 12 is sequentially wound and thus almost the entire region of the absorbing member 12 has absorbed the ink, as described below. For this reason, it is preferable that the length of the absorbing member 12 is set to several hundred times the effective printing width of the head unit 2 so as to allow the replacement period of the absorbing member 12 to be extended to a practically sustainable time period.

The absorbing member 12 configured as described above is tensed by the support mechanism 9, as shown in FIG. 5.

The support mechanism 9 includes a running mechanism 13 and a moving mechanism (moving device) 14 which are installed at both sides of the head unit 2, that is, one side and the other side in an arrangement direction of the printing head 21 in this embodiment. In this instance, in FIG. 5, a portion of the head unit 2 is omitted, and only two printing heads 21 are illustrated.

The running mechanism 13 is installed on a pair of support substrates 15A and 15B which are provided at both sides of the head unit 2, and runs the absorbing member 12 from one side to the other side in the Y-axis direction along the nozzle row L of the printing head 21. In this embodiment, since two absorbing members 12 are installed as described above, two running mechanisms 13 are installed in response to the number of the absorbing members. At that time, the number of the absorbing members 12 is not limited to two, and, for example, may be installed by as many as the number of the nozzle rows L of the printing heads 21. In this instance, as many of the running mechanism 13 may be installed in numbers corresponding to the number of the absorbing members 12.

The running mechanism 13 includes a delivery unit 13A for delivering the absorbing member 12 to one side support substrate 15A, and a winding unit 13B for winding the absorbing member 12 around the other side support substrate 15B.

The delivery unit 13A has a delivery reel 16, around which the absorbing member 12 of a predetermined length is already wound and maintained, and a delivery motor 16A for rotating the delivery reel 16, and pulleys 41, 42 and 43 for guiding the absorbing member 12 delivered from the delivery reel 16.

The pulley 42 of the delivery unit 13A functions as a tension pulley for exerting a predetermined tension on the absorbing member 12 at the support substrate 15A. The pulley 42 is supported by a lever member 44 in such a manner that it is able to rotate around a rotation axis of the pulley 41. The lever member 44 is configured to be biased toward one side of a rotation direction (side exerting the tension) by a tension spring 45.

The winding unit 13B has a winding reel 17 for winding the absorbing member 12, a winding motor 17A for rotating the winding reel 17, and pulleys 51, 52 and 53 for guiding the absorbing member 12 to the winding reel 17.

The pulley 52 of the winding unit 13B functions as a tension pulley for exerting a predetermined tension on the absorbing member 12 at the support substrate 15B. The pulley 52 is supported by a lever member 54 in such a manner that it is able to rotate around a rotation axis of the winding reel 17. The lever member 54 is configured to be biased toward one side of a rotation direction (side exerting the tension) by a tension spring 55.

The pulley 51 of the winding unit 13B is provided with a rotation plate 56 in an integrally rotatable manner, and the rotation plate is formed with a plurality of holes 57 for generating a pulse in an outer circumferential portion thereof. An optical sensor 58 for detecting the holes 57 is provided at a position opposite to a portion of the outer circumferential portion of the rotation plate 56. The optical sensor 58 is configured to detect the running distance of the absorbing member 12 by counting the detected numbers of the holes 57 at the outer circumferential portion of the rotation plate 56 which rotates integrally with the pulley 51.

At the other side in the rotation direction of the lever member 44 of the delivery unit 13A, a limit switch 46 is provided which is turned on if the limit switch comes into contact with the lever member 44 and then is pressed, while is turned off if the press is released. In addition, at both sides in the rotation direction of the lever member 54 of the winding unit 13B, limit switches 59*a* and 59*b* are provided which are turned on if the limit switches come into contact with the lever member 54 and then are pressed, while are turned off if the press is released. The press resistance of the limit switches 46, 59*a* and 59*b* is sufficiently low. Accordingly, when these limit switches 46, 59*a* and 59*b* are pressed, the limit switches are retracted without resisting against most of the pressing pressure. If the pressing pressure is released, the limit switches return smoothly to their original positions.

The limit switches 46, 59*a* and 59*b* are provided to maintain the tension of the absorbing member 12 within a predetermined range at the time of running. For example, in the case where the limit switch 59*a* is turned on, the rotation speed of the winding reel 17 is controlled to decrease, so that the tension of the absorbing member 12 is lowered. In addition, in the case where the limit switch 59*b* is turned on, the rotation speed of the winding reel 17 is controlled to increase, so that the tension of the absorbing member 12 is increased. Further, in the case where the limit switch 46 is turned on, it is determined that it is a case (the absorbing member 12 is caught, lack of an absorbing member 12 wound around the delivery reel 16, or the like) beyond the scope of the assumption in which a tension exceeding the predetermined range is exerted on the absorbing member 12, and thus the control is performed to stop the rotation of the winding reel 17 to prevent the absorbing member 12 from being cut.

The moving mechanism 14 moves the absorbing member 12 in a direction (X-axis direction) perpendicular to the extension direction (Y-axis direction) of the nozzle row L, such that the absorbing member 12 is moved opposite to the nozzles 24 between a flushing position (liquid receiving position) which can receive the ink ejected from the nozzles 24 and a retraction position which is retracted from the ejection path of the ink ejected from the nozzles 24 so as not to receive the ink.

The moving mechanism 14 includes a pair of moving mechanism units 14A and 14B provided on the support substrates 15A and 15B. Since the moving mechanism units 14*a* and 14B are synchronously operated, the support substrates 15A and 15B are simultaneously moved by the same amount at the same speed in the X-axis direction.

The moving mechanism units 14A and 14B have ball screw stages 70 provided at each upper surface side (+Z side) of the support substrates 15A and 15B, that is, at the surface opposite to the surface at which the delivery reel 16 or the winding reel 17 is provided, motors 72, such as a stepping motor, for rotating a male-type ball screw 71 about a shaft, and fixing blocks 73 which are fixed to the support substrates 15A and 15B and have a female-type screw portion (not illustrated) meshed with the ball screw 71 and moved by the ball screw 71. In this instance, the motor 72 and the ball screw stage 70 are fixed to the printer 1 by a fixing member (not illustrated).

With the above configuration, in the moving mechanism units 14A and 14B, the ball screws 71 are rotated by rotation of the motor 72, and then the fixing blocks 73 meshed with the ball screws 71 are moved in the longitudinal direction of the ball screw 71, that is, in the X-axis direction. By the movement of the fixing blocks 73, the support substrates 15A and 15B are also moved, and thus the absorbing member 12 is moved. At that time, the motors 72 are able to rotate in a forward and backward direction, and the fixing blocks 73 or the support substrates 15A and 15B, and the absorbing member 12 are able to move in both sides of the X-axis direction. The motors 72 are controlled by a controller (not illustrated), such that the moving mechanism 14 moves the position of each absorbing member 12 with respect to the head unit 2 (nozzle row L) between the flushing position and the retraction position as the previously set.

Figure 7:
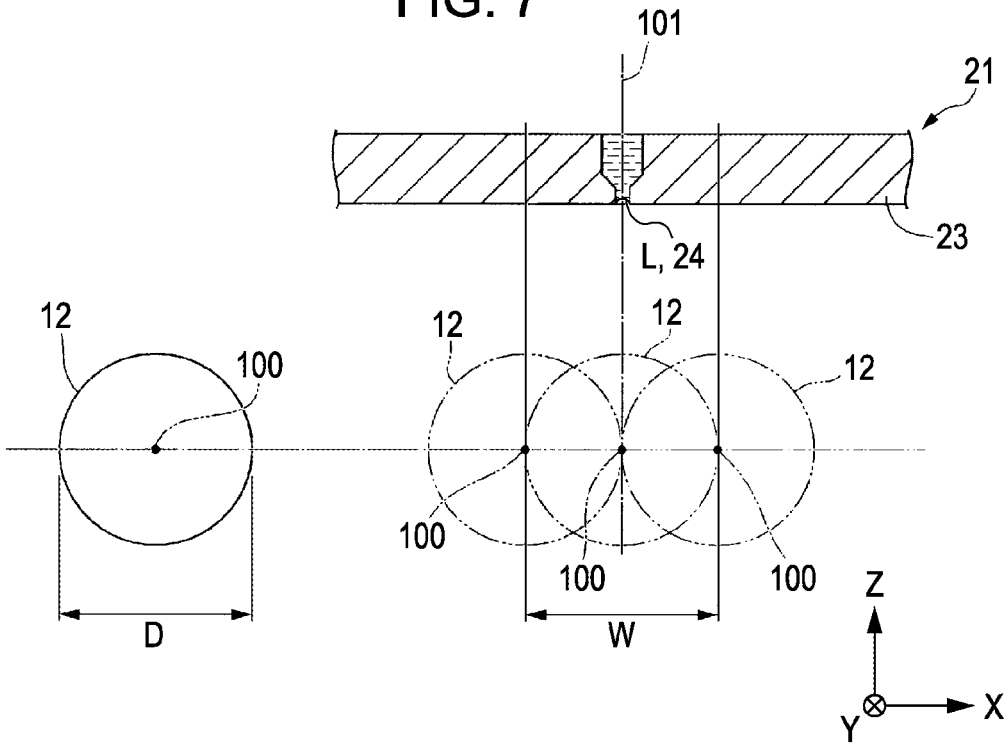
FIG. 7 is a view illustrating a retraction position of an absorbing member according to an embodiment of the invention.

FIG. 7 is a view illustrating the retraction position of the absorbing member 12. Reference numeral 101 indicates the ejection path of the ink T from the nozzle row L (the nozzles 24).

As described above, the absorbing member 12 has the ink receiving region D. The term "retraction position" means a position in which the nozzle row L is not opposite to the ink receiving region D of the absorbing member 12, more specifically, a position in which the ink receiving region D is retracted from the ejection path 101. Since the ink receiving region D of the embodiment is set to 0.4 mm in the X-axis direction, the ink can be received even though the position of the center line 100 of the absorbing member 12 in the X-axis direction is offset as ±0.2 mm from the ejection path 101. That is, if the center line 100 is positioned within the region of the width W (0.4 mm) which is identical to the ink receiving region D centered on the ejection path 101, the absorbing member 12 can receive the in ejected from the nozzle row L (indicated by a dashed-two dotted line in FIG. 7).

For this reason, in the retraction position, the absorbing member 12 is located at the position in which the center line 100 is located out of the region of the width W centered on the ejection path 101 (may be at the −X side and the +X side with respect to the ejection path 101). In this instance, the retraction position is out of the region of the width W centered on the ejection path 101 in this embodiment, and is set at the −X side with respect to the ejection path 101.

Figure 8:
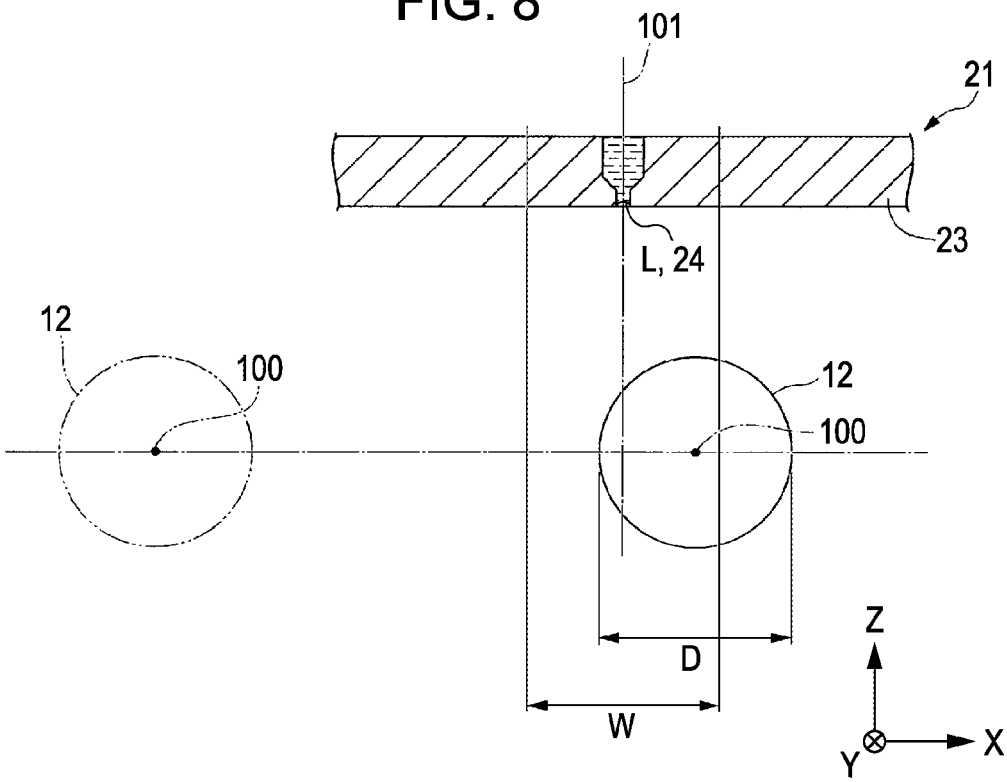
FIG. 8 is a view illustrating a flushing position of an absorbing member according to an embodiment of the invention.

FIG. 8 is a view illustrating the flushing position of the absorbing member 12.

The term "flushing position" is the position in which the ink receiving region D of the absorbing member 12 is opposite to the nozzle row L, more specifically, the position in which the ink receiving region D is positioned on the ejection path 101. The flushing position of the embodiment is a position in which the ink receiving region D of the absorbing member 12 is opposite to the nozzle row L, and is set to a position in which the position of the center line 100 of the absorbing member 12 is different from the position (the ejection path 101) of the nozzle row L in the X-axis direction. That is, the flushing position of the embodiment is set to the position in which the center line 100 is positioned within the region of the width W (0.4 mm) which is equal to the ink receiving region D centered on the ejection path 101, and the ejection path 101 is not identical to the center line 100 (may be at the −X side and the +X side with respect to the ejection path 101).

The flushing position of the embodiment is set to the position in which the center line 100 is located at the side (+X side) opposite to the retraction position across the nozzle rows L (the ejection path 101). That is, the center line 100 is located at the side far away from the nozzle row L (ejection path 101) with respect to the retraction position.

Next, the flushing operation of the above-described printer 1 will be described. In this instance, the operation of the printer 1 according to the embodiment is wholly controlled by the above-described controller (not illustrated).

When the flushing operation is executed, the flushing unit 11 drives the moving mechanism 14 to move the absorbing member 12, which is tensed between the support substrates 15A and 15B, in the X-axis direction, such that the absorbing member 12 is moved to the flushing position shown in FIG. 8 from the retraction position shown in FIG. 7.

Figure 9:
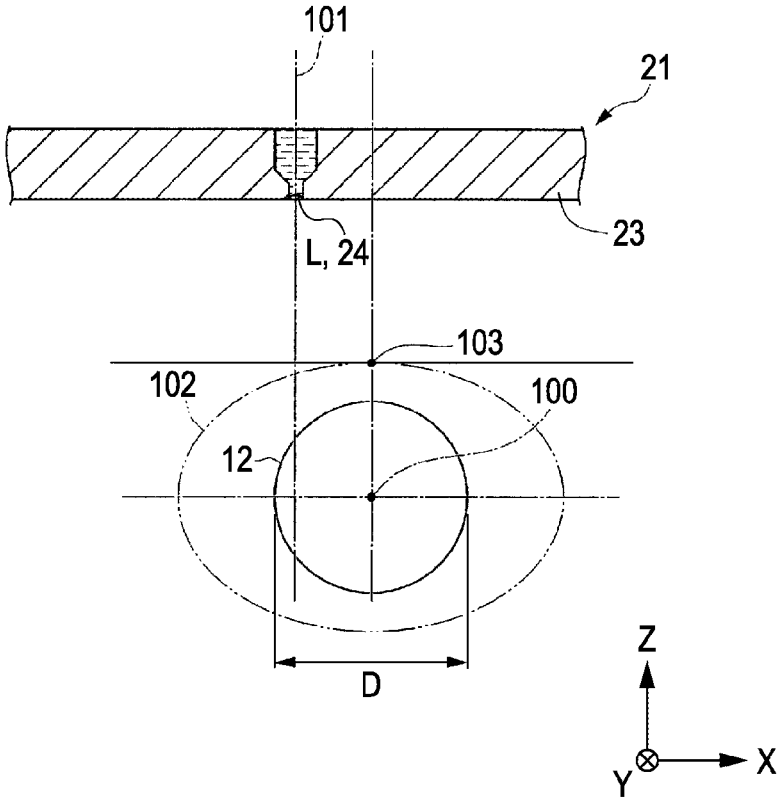
FIG. 9 is a view illustrating a vibration shape of an absorbing member when it is moved from a retraction position to a flushing position, in an embodiment of the invention.

FIG. 9 is a view illustrating the shape of the vibration in the absorbing member 12 in accordance with the movement from the retraction position to the flushing position. Reference numeral 102 denotes outer edge 102 of the vibration region of the absorbing member 12.

As shown in FIG. 9, if the absorbing member 12 is moved to the flushing position from the retraction position and is stopped at the flushing position, the absorbing member 12 vibrates at a predetermined width in the X-axis direction and the Z-axis direction by the inertial force generated from the movement. Since the inertial force strongly acts in the movement direction (X-axis direction), the outer edge 102 of the vibration region of the absorbing member 12 is formed in a substantially oval shape, with it being long in the X-axis direction and short in the Z-axis direction, with the center line 100 as the center.

The flushing position of the embodiment is set to the position in which the ink receiving region D is opposite to the nozzle row L in the Z-axis direction, and the position of the center line 100 of the absorbing member 12 is different from the position of the nozzle row L in the X-axis direction. For this reason, even though the absorbing member 12 vibrates in the X-axis direction at the flushing position, the vertex (indicated by reference numeral 103) of the vibration can be deviated from the nozzle row L. As a result, even if the vertex 103 of the absorbing member 12 comes into contact with the nozzle surface 23 due to the vibration, the absorbing member 12 does not come into contact with the nozzle row L, thereby preventing breakdown of the meniscus due to the contact of the absorbing member 12 with the nozzle row L. Accordingly, it is possible to eliminate a case where the flushing operation should be reattempted due to the influence of the vibration of the absorbing member 12. As a result, the effectiveness of the flushing operation can be improved.

The flushing operation is initiated when the vibration region of the absorbing member 12 in the X-axis direction shown in FIG. 9 is dampened and thus is within the predetermined width, so as to prevent the leakage of the received ink from the absorbing member 12. Accordingly, in view of the effectiveness of the flushing operation, it is preferable that in the vibration of the absorbing member 12 due to the movement from the retraction position to the flushing position, the amplitude thereof in the X-axis direction is small. For this reason, when the absorbing member 12 is moved from the retraction position to the flushing position, the moving mechanism 14 according to the embodiment is configured to decelerate the movement of the absorbing member 12 further to the front side than the flushing position in the X-axis direction.

Figure 10:
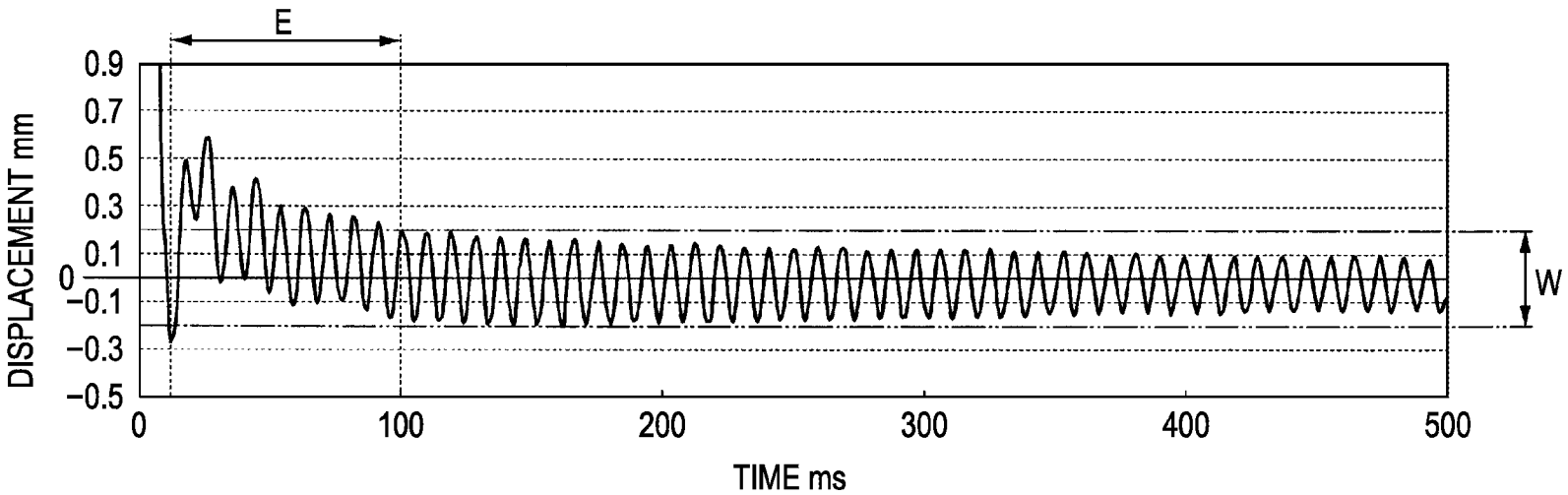
FIG. 10 is a view illustrating behavior of vibration of an absorbing member in the X-axis direction in a case where an absorbing member moving at a predetermined speed is put on deceleration further to the front side than the flushing position, in an embodiment of the invention.
Figure 11:
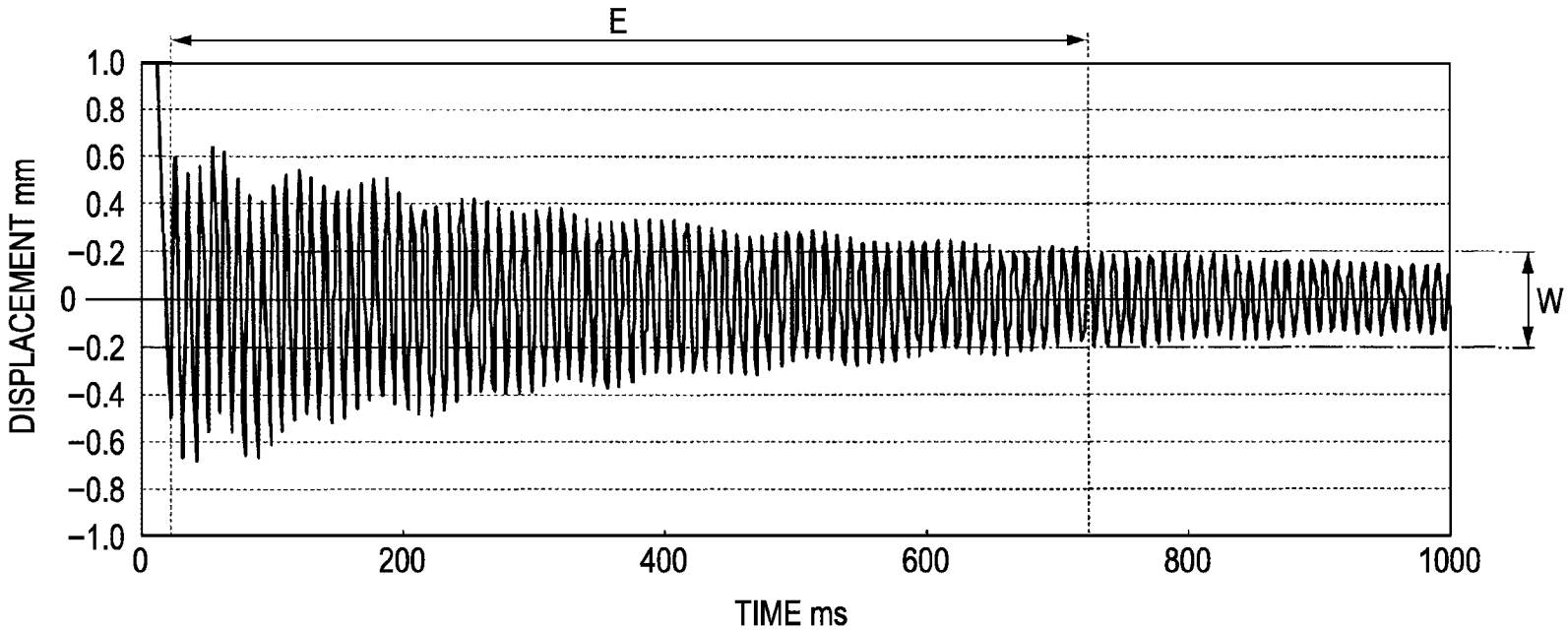
FIG. 11 is a view illustrating behavior of vibration of an absorbing member in the X-axis direction in a case where an absorbing member moving at a predetermined speed is suddenly stopped at a flushing position, in an embodiment of the invention.

FIG. 10 is a view illustrating behavior of the vibration of the absorbing member 12 in the X-axis direction in the center of the absorbing member 12 in a case where the absorbing member 12 moving at the predetermined speed is decelerated further to the front side than the stop position. FIG. 11 is a view illustrating behavior of the vibration of the absorbing member 12 in the X-axis direction in the center of the absorbing member 12 in a case where the absorbing member 12 moving at a predetermined speed is suddenly stopped at the stop position. In FIGS. 10 and 11, a vertical axis indicates a displacement (mm) with respect to the stop position, while a horizontal axis indicates a time (ms). In this instance, the displacement of the vertical axis is designated by a + symbol for the −X side (front side) with respect to the stop position, and is designated by a − symbol for the +X side (rear side).

Comparing FIG. 10 with FIG. 11, it will be noted that the amplitude in the case shown in FIG. 10 where the absorbing member 12 is decelerated further to the front side than the stop position is smaller and damper than that in the case shown in FIG. 11 where the absorbing member 12 is suddenly stopped at the stop position, and thus the time for reaching the predetermined width (for example, the width W of ±0.2 mm centered on the stop position) is short. Since variations in moving speed of the absorbing member 12 are large in the case of suddenly stopping, the inertial force acts strongly. For this reason, the case of decelerating the movement of the absorbing member 12 at the front takes the time to reach the stop position. However, considering the damping time of the vibration, it is favorable to the start time of the flushing operation rather than the case of suddenly stopping the absorbing member.

Here, if the behavior of the vibration of the absorbing member 12 shown in FIG. 10 is observed, since the absorbing member 12 moving at a predetermined speed is put on deceleration further to the front side than the stop position, it can be known that the absorbing member 12 has exerted on it the inertial force resulting from the deceleration from the front reaching the stop position, and vibrates in the X-axis direction from the front. The center of the amplitude region is shifted further to the front side than the stop position in the region E from the deceleration start to the predetermined time (about 100 ms in FIG. 10).

In addition, both ends of the amplitude are not within the width of the predetermined width W in the region E. For this reason, in a case where the position of a displacement 0 in FIG. 10 is set to the position (the ejection path 101) of the nozzle row, a time greater than 100 ms is needed so as to receive the ink without spilling it during flushing.

Since the flushing operation is performed between the printing sheet and a next printing sheet, the distance between the printing sheet and the printing sheet is determined depending upon the time needed for the flushing operation. This determines the throughput indicating how many printing sheets can be printed within a predetermined time. In order to improve the throughput, it is desirable to shorten the time needed for the flushing operation.

During flushing, it is common to prevent the nozzles 24 from being clogged due to ink with the increased viscosity or to adjust the meniscus of the nozzle 24 by preliminarily ejecting the ink from each nozzle 24 constituting the nozzle row L, for example, 72 shots (the weight of the ink per one shot is about 20 ng), at high speed. The time needed for the ejection is about 5 ms, and is within a half cycle of the vibration of the absorbing member 12 shown in FIG. 10. For this reason, as shown in FIG. 10, it is not necessary that the width of the vibration is always within the range of the predetermined with W, as shown in FIG. 10. Even in view of a variation such as an error in position precision, if 1.5 cycle of the vibration is within the predetermined width W, it is possible to receive the ink without spilling it due to the flushing.

Accordingly, this embodiment is set in such a manner that the moving mechanism 14 decelerates the absorbing member 12 further to the front side than the nozzle row L in the X-axis direction and that the flushing position is located at the position (rear side) opposite to the retraction position where the center line 100 is located across the nozzle rows L. This is explained with reference to FIG. 12.

Figure 12:
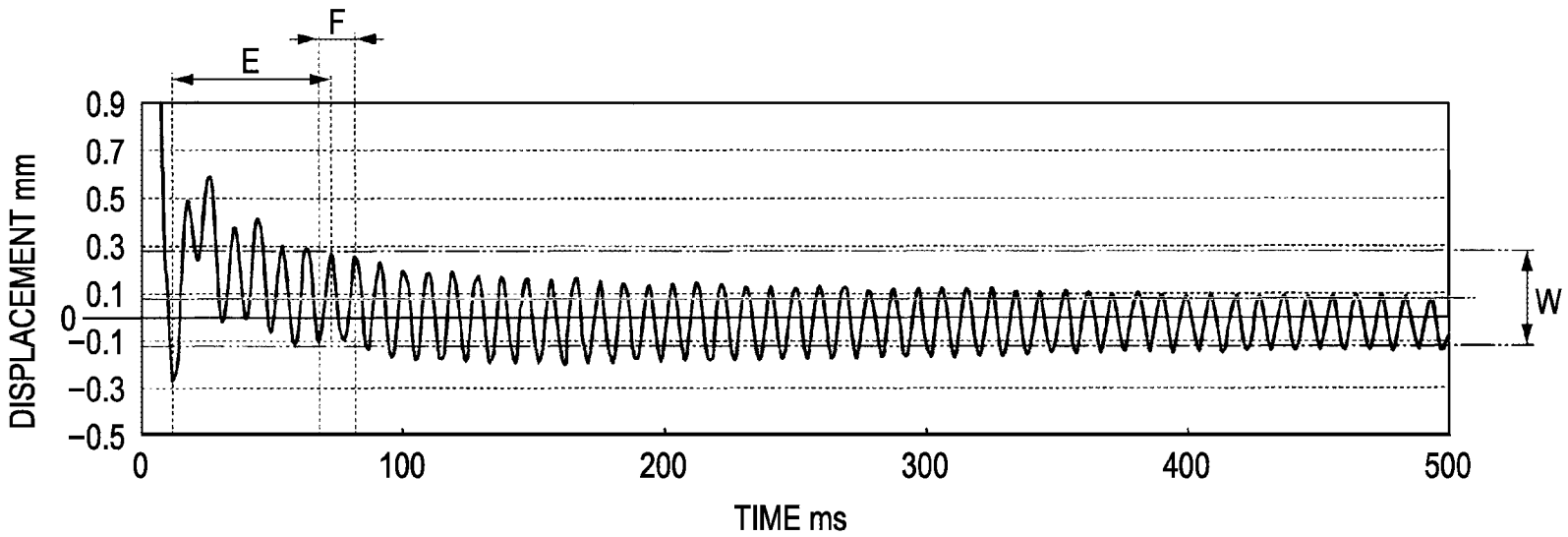
FIG. 12 is a diagram illustrating a time from a movement start of an absorbing member to the start of a flushing operation when a position of a center line is shifted to a rear side with respect to a nozzle row in a flushing position, in an embodiment of the invention.

FIG. 12 is a diagram illustrating the time from the start of movement of the absorbing member 12 to the start of the flushing operation when the position of the center line 100 is shifted to the rear side with respect to the nozzle row L in the flushing position. In FIG. 12, a vertical axis indicates a displacement amount (mm) when the flushing position (stop position of the absorbing member 12) is set to 0, while a horizontal axis indicates a time (ms). In this instance, in FIG. 12, since the center line 100 of the absorbing member 12 is shifted by the predetermined amount (for example, 0.08 mm) in the side (rear side) opposite to the retraction position across the nozzle row L in the flushing position of the embodiment, the position of the nozzle row L is relatively shifted to the front side (+side) by as much as the shift amount. Since the position of the absorbing member 12 is set to 0, the position of the nozzle row L is a position indicated by a dashed-dotted line which is drawn at +0.08 mm.

Since the absorbing member 12 according to the embodiment has the ink receiving region D having a width of 0.4 mm in the X-axis direction, as described above, if 1.5 cycle of the amplitude of the center line 100 is within the region of the width W (0.4 mm) which is equal to the ink receiving region D centered on the ejection path 101, as shown in FIG. 7, the absorbing member 12 can receive the ink ejected from the nozzle row L without spilling it, even though the absorbing member vibrates.

In FIG. 12, since there is a zone F in which 1.5 cycle of the amplitude of the center line 100 is within the width of 0.4 mm centered on +0.08 mm, the flushing is performed in the zone F. Since the flushing time is actually about 0.5 cycle of the amplitude, if the flushing is performed within the 0.5 cycle including the center of the 1.5 cycle of the amplitude, the back and forth 0.5 cycle has a margin when being deviated due to variability or the like, and thus the ink can be reliably received by the absorbing member 12.

And, since the region from starting the deceleration of the absorbing member 12 till initiating the flushing is a zone corresponding to E in FIG. 10, the region is about 70 ms, so that is can be shortened by 30 ms as compared with FIG. 10. Accordingly, as shown in FIG. 12, in the case where the center line 100 is located more at the rear side than the nozzle row L at the flushing position, the time in which the amplitude region of the absorbing member 12 is within the range of the width W centered on the nozzle row L, as compared with the case in which the center line 100 is located in alignment with the nozzle row L in the flushing position (for example, a case where the nozzle row L is stopped at the stop position (0 mm) in FIG. 10).

Accordingly, the above-described embodiment employs the printer 1 including the printing head 21 having the nozzle rows L formed from the plurality of nozzles 24, in which the nozzles for ejecting the ink in the Z-axis direction are discretely arranged in the Y-axis direction perpendicular to the Z-axis direction; the linear absorbing member 12 which is spaced apart from the nozzles 24 at a predetermined distance in the Z-axis direction, is tensed in the Y-axis direction, and has the ink receiving region D capable of receiving the ink with the predetermined width W in the X-axis direction perpendicular to the Z-axis direction and the Y-axis direction; and the moving mechanism 14 which arranges the nozzle row L and the ink receiving region D to be opposed to each other in the Z-axis direction, and moves the absorbing member 12 to the flushing position in which the nozzle row L and the center line 100 of the absorbing member 12 are differently positioned in the X-axis direction by the movement of the flushing position, when the fluid is preliminary ejected from the nozzle row. Therefore, even though the absorbing member 12 vibrates in the Z-axis direction, the vertex of the vibration can be deviated from the nozzle row L. As a result, it is possible to prevent breakdown of the meniscus due to the contact of the absorbing member 12 with the nozzle row L.

According to the embodiment, therefore, the flushing operation can be effectively performed in the case where the linear absorbing member 12 is used as the member for receiving the ink.

In addition, the embodiment employs the configuration in which the moving mechanism 14 moves the absorbing member 12 in the X-axis direction between the flushing position and the retraction position in which the nozzle row L and the ink receiving region D are not opposite to each other. Therefore, the absorbing member 12 located at the flushing position can receive the ink during flushing operation, while the absorbing member 12 can be located at the retraction position during printing operation to ensure the ejection path of the ink from the nozzles 24.

In addition, the embodiment employs the configuration in which the moving mechanism 14 decelerates the movement of the absorbing member 12 further to the front side than the flushing position in the X-axis direction, when the absorbing member 12 is moved from the retraction position to the flushing position. Therefore, when the absorbing member 12 is moved from the retraction position to the flushing position, the absorbing member 12 is decelerated further to the front side than the flushing position. As a result, it is possible to suppress the vibration of the absorbing member 12 in the X-axis direction, as compared with the case where the absorbing member 12 is suddenly stopped at the flushing position. Therefore, it is possible to shorten the time needed to initiate the flushing operation.

Further, the embodiment employs the configuration in which the center line 100 is located at the position opposite to the retraction position across the nozzle row L in the flushing position, and the moving mechanism 14 decelerates the absorbing member 12 further to the front side than the nozzle row L in the X-axis direction. Therefore, when the absorbing member 12 is moved from the retraction position to the flushing position, if the absorbing member 12 is decelerated further to the front side than the nozzle row L, the absorbing member 12 starts to vibrate in the X-axis direction from the front. For this reason, if the position of the center line 100 in the flushing position is arranged more in the rear side than the nozzle row L in the X-axis direction, the absorbing member 12 starts to vibrate in the X-axis direction from the front, and the time from the start of movement of the absorbing member 12 to the start of the flushing operation can be shortened.

In addition, the embodiment employs the configuration in which the preliminary ejection is initiated by the controller when the amplitude region of the vibration of the absorbing member 12 in the X-axis direction due to the deceleration is within the region of the predetermined width W centered on the nozzle row L. Therefore, if the absorbing member 12 vibrates in the X-axis direction within the predetermined width W of the ink receiving region D, the flushing operation can be initiated at a timing avoiding leakage of the received ink when the vibration region is within the region of the predetermined width W centered on the nozzle row L.

Further, in the embodiment, the control unit employs the configuration in which the flushing operation is executed within one cycle of the vibration after the flushing operation is initiated. Therefore, it is possible to prevent leakage of the received ink due to the vibration by carrying out the flushing operation within one cycle of the vibration of the absorbing member 12.

While the preferred embodiments of the invention are described as above with reference to the accompanying drawings, it is needless to say that the invention is not limited to the preferred embodiments. It is apparent that various modifications and corrections can be made within the scope of the technical spirit according to the claims.

For example, in the above-described embodiment, a configuration is described in which the invention is applied to the line head type printer. However, the invention is not limited thereto, but may be applied to a serial type printer.

In addition, in the above-described embodiments, a configuration is described in which the absorbing member 12 always moves between a head and the printing sheet (medium). However, the invention is not limited thereto, but may adopt a configuration in which the absorbing member 12 moves to a region (for example, a region on the side portions of the head) deviated from the positions right below the head upon retracting the absorbing member 12.

Further, in the above-described embodiments, the fluid ejecting apparatus of the invention is applied to the ink jet printer, but it may be applied to a fluid ejecting apparatus for ejecting or discharging a fluid other than ink. That is, it may be applied to various fluid ejecting apparatuses including a fluid ejecting head for ejecting a minute number of liquid droplets. In this case, the expression "liquid droplets" means the fluid ejected from the fluid ejecting apparatus, and includes a liquid having a granular shape, a tear shape, or a thread shape as a trailing shape. Further, here, the fluid may be a material which can be ejected from the liquid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which particles of a functional material having a solid material such as a pigment or a metal particle are dissolved, dispersed, or mixed with a solvent in addition to a fluid, as one state of a substance. In addition, ink described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precision pipette, a printing apparatus, or a micro dispenser may be used.

In addition, a fluid ejecting apparatus for ejecting a pinpoint of lubricant to a precision machine such as a watch or a camera, a fluid ejecting apparatus for ejecting a transparent resin liquid such as a UV-curing resin onto a substrate in order to form a minute hemispherical lens (optical lenses) used for an optical transmission element or the like, or a fluid ejecting apparatus for ejecting an etching liquid such as an acid liquid or an alkali liquid in order to perform etching on a substrate or the like may be adopted.

What is claimed is:

1. A fluid ejecting apparatus comprising:

a fluid ejecting head having nozzle rows formed of a plurality of nozzles, in which the nozzles for ejecting a fluid in a first direction are discretely arranged in a second direction perpendicular to the first direction;

an absorbing member which is spaced apart from the nozzles at a predetermined distance in the first direction, is tensed in the second direction, and has a fluid receiving region capable of receiving the fluid at a predetermined width in a third direction perpendicular to the first direction and the second direction; and a moving device which moves the absorbing member to a fluid receiving position in which the nozzle rows and the fluid receiving region to be opposed to each other in the first direction, and in which the nozzle rows and a center line of the absorbing member are differently positioned in the third direction, when the fluid is preliminary ejected from the nozzle row.

2. The fluid ejecting apparatus according to claim 1, wherein the moving device moves the absorbing member in the third direction between the fluid receiving position and a retraction position in which the nozzle row and the fluid receiving region are not opposite to each other.

3. The fluid ejecting apparatus according to claim 2, wherein the moving device decelerates the movement of the absorbing member further to the front side than the fluid receiving position in the third direction, when the linear member is moved from the retraction position to the fluid receiving position.

4. The fluid ejecting apparatus according to claim 3, wherein the center line is located at a position opposite to the retraction position across the nozzle row in the fluid receiving position, and the moving device decelerates the linear member further to the front side than the nozzle row in the third direction.

5. The fluid ejecting apparatus according to claim 4, further comprising a control device which initiates preliminary ejection when an amplitude region of the vibration of the absorbing member in the third direction due to the deceleration is within a region of a predetermined width centered on the nozzle row.

6. The fluid ejecting apparatus according to claim 5, wherein the preliminary ejection is executed within one cycle of the vibration after the preliminary ejection is initiated.

* * * * *